US007219486B1

(12) United States Patent
Conforth

(10) Patent No.: US 7,219,486 B1
(45) Date of Patent: May 22, 2007

(54) MOISTURE-WICKING SADDLE PAD

(75) Inventor: Michael Conforth, Manalapan, NJ (US)

(73) Assignee: Union Hill Corp., Englishtown, NJ (US)

( * ) Notice: Subject to any disclaimer, the term of this patent is extended or adjusted under 35 U.S.C. 154(b) by 0 days.

(21) Appl. No.: 10/920,889

(22) Filed: Aug. 18, 2004

(51) Int. Cl.
*B68B 3/00* (2006.01)

(52) U.S. Cl. ..... 54/66

(58) Field of Classification Search ..... 54/65, 54/66, 79.3, 79.4; D30/145; 119/850; 5/500
See application file for complete search history.

(56) References Cited

U.S. PATENT DOCUMENTS

| | | | | | |
|---|---|---|---|---|---|
| 1,006,960 | A | | 10/1911 | Leibe | 54/65 |
| 1,080,901 | A | | 12/1913 | Eilers | 54/65 |
| 1,569,955 | A | * | 1/1926 | Falter | 5/500 |
| 1,698,232 | A | | 1/1929 | Katz | 54/65 |
| 2,072,188 | A | | 3/1937 | Tauber | 54/66 |
| 3,584,436 | A | * | 6/1971 | Gulyas | 54/79.3 |
| 3,914,488 | A | | 10/1975 | Gorrafa | 428/397 |
| 4,136,506 | A | * | 1/1979 | Miller | 54/66 |
| 4,695,496 | A | * | 9/1987 | Lee | 54/65 |
| 5,018,340 | A | | 5/1991 | Marshall | 54/66 |
| 5,058,367 | A | | 10/1991 | Evertson | 54/66 |
| 5,119,618 | A | * | 6/1992 | Streck | 54/66 |
| 5,353,577 | A | | 10/1994 | Thurston | 54/66 |
| 5,488,746 | A | * | 2/1996 | Hudson | 5/500 |
| 5,555,584 | A | | 9/1996 | Moore et al. | 12/142 |
| 5,575,139 | A | | 11/1996 | Green | 54/66 |
| 5,591,523 | A | | 1/1997 | Aneja | 428/397 |
| 5,782,070 | A | * | 7/1998 | Knight et al. | 54/66 |
| 5,970,544 | A | * | 10/1999 | Kardell | 5/500 |
| 5,987,668 | A | * | 11/1999 | Ackley | 5/500 |
| 6,013,368 | A | | 1/2000 | Aneja | 428/397 |
| 6,067,781 | A | * | 5/2000 | Ford et al. | 54/66 |
| 6,421,989 | B1 | | 7/2002 | Leson | 54/66 |
| 6,459,015 | B1 | | 10/2002 | Lyon | 604/368 |
| 6,484,480 | B2 | * | 11/2002 | Rauch | 54/66 |
| 2002/0104295 | A1 | | 8/2002 | Rauch | 54/66 |
| 2002/0152730 | A1 | * | 10/2002 | Landi et al. | 54/65 |
| 2002/0162307 | A1 | * | 11/2002 | Arnold | 54/66 |
| 2003/0177742 | A1 | | 9/2003 | Brownlie | 54/66 |

OTHER PUBLICATIONS

The New Textile Technology *World & I* by Turbak Jan. 1987.
Viewpoint: 21st Century Fibers *International Fiber Journal* Aug. 1999.

* cited by examiner

*Primary Examiner*—Thomas Price
(74) *Attorney, Agent, or Firm*—Siegmar Silber

(57) ABSTRACT

The saddle pads have a lower covering layer of a comfort fabric formed from a passive performance fiber. In use this layer lies against the back and sides of a horse and acts to wick perspiration from the horse. The perspiration is then absorbed by the cushioning layer which consists of a polymeric foam backing. The foam backing is, in turn, covered by another hydrophilic layer, which in one embodiment is synthetic sheepskin and in the other is a cloth cover. The saddle pads are constructed with a withers relief gusset.

6 Claims, 4 Drawing Sheets

MOISTURE-WICKING SADDLE PAD

BACKGROUND OF THE INVENTION

1. Field of the Invention

The present invention relates to equine saddle pads, and more particularly to saddle pads having superior moisture-wicking capacity. The moisture-wicking capacity removes perspiration from the saddle area and enhances localized cooling of the horse.

2. Description of the Prior Art

A saddle pad is placed between the horse and the saddle and is traditionally structured from felt, cotton, wool, and sheepskin. More recently cushioning materials such as artificial sheepskin, polyurethane foams and other plastic foams of both open- and closed-cell configurations have been used.

Typically, in constructing saddle pads, extra care is taken to protect the withers and back of the horse from irritation from the weight and movement of the saddle and rider. The saddle pad also needs to enhance the stability of the saddle mounting so that slippage from the proper location on the horse's back is avoided.

In the disclosure which follows, significant attention is paid to the materials of construction and the teachings of prior art fibers have been considered. From 1970 to date E.I. du Pont de Nemours and Company, Wilmington, Del. through the DuPont Dacron Research Laboratory in North Carolina and the Central Research and Development in Delaware developed a family of passive performance fibers utilizing microfiber filaments. These materials are described briefly in the article entitled Viewpoint: 21$^{st}$ Century Fibers, *International Fiber Journal* (August, 1999-Vol. 14, Issue 4). The DuPont development of sculpted fibers variously described as oblong, four-channel and scalloped-oval, longitudinally grooved fibers are the subject, among others, of U.S. Pat. No. 3,914,488 to Gorrafa and U.S. Pat. Nos. 5,591,523, 5,626,961, 5,736,243 and, 6,013,368 to Aneja. The sculpted fibers (not round) led to the introduction of the COOLMAX® product group of fibers. Further background of this art is provided in U.S. Pat. No. 5,626,961, which background is incorporated herein by reference.

In the past, several saddle pad patents and published patent applications have come to the attention of the inventor hereof. These are:

Published Patent Applications

| Appl. No. | Inventor | U.S. Cl. | Pub. Date |
|---|---|---|---|
| 2003/0177742 | Brownlie | 54/66 | Sep. 25, 2003 |
| 2002/0162307 | Arnold | 54/66 | Nov. 7, 2002 |
| 2002/0104295 | Rauch | 54/66 | Aug. 8, 2002 |

U.S. Patents

| Patent No. | Inventor | U.S. Cl. | Issue Date |
|---|---|---|---|
| 6,459,015 | Lyon | 604/368 | Oct. 1, 2002 |
| 6,421,989 | Leson | 54/66 | Jul. 23, 2002 |
| 5,575,139 | Green | 54/66 | Nov. 19, 1996 |
| 5,353,577 | Thurston | 54/66 | Oct. 11, 1994 |

Brownlie, U.S. patent application 2003/0177742, teaches a two-chambered inflatable interface pad with each chamber having a foam core within a valved, thin-skinned envelope.

Arnold, U.S. patent application No. 2002/0162307, teaches a numnah having a foam polymer base layer and a planar polymer foam scrim layer attached thereto. The foam polymer layer in the first embodiment is of closed-cell, cross-linked polyolefin foam; and in the other embodiment, of open-cell PVC foam.

Rauch, U.S. patent application No. 2002/0104295, teaches a multi-layer saddle pad of non-woven polypropylene foam. The layers are maintained free of any permanent attachments along the periphery.

Lyon, U.S. Pat. No. 6,459,015, teaches a disposable saddle blanket of non-woven polypropylene for absorbing and dispersing therewithin the perspiration from the horse or pony.

Leson, U.S. Pat. No. 6,421,989, teaches a two-panel saddle pad constructed of a thermoformed polymeric material with longitudinal channels in the panels and a connector strip therebetween.

Green, U.S. Pat. No. 5,575,139, teaches a non-slip saddle pad that, when in use, has an innermost layer of open-celled plastic foam (with the cellular structure exposed) in direct contact with the horse. The open cells act like suction cups to reduce slippage of the saddle.

Thurston, U.S. Pat. No. 5,353,577, teaches a reversible saddle pad in which billet keepers can, upon reversing the pad, be moved through an aperture to the opposite side of the saddle pad and avoid the billet keepers irritating the horse. Both sides of the pad have a fleece-like covering.

While the above patented saddle pads use synthetic materials, there still remains a wicking-absorption-evaporation problem which remains unresolved by the combinations shown.

The patents referred to herein are representative of the present state-of-the-art, but do no singly or in combination exhibit the characteristics of the moisture-wicking saddle pad presented, infra. The citing of the patents is not intended as an admission that any such patent constitutes prior art against the claims of the present application. Applicant does not waive any right to take any action that would be appropriate to antidate or otherwise remove any listed document as a competent reference against the claims of this application.

Other technical problems are overcome or resolved by the invention disclosed herein. The innovative approach in the design and construction of the saddle pad hereof is contained in the description which follows.

SUMMARY

The disclosed invention provides a saddle pad, shown in two embodiments, each having a lower covering layer of a comfort fabric formed from a passive performance fiber. In use this layer lies against the back and sides of a horse and acts to wick perspiration from the horse. The perspiration is then absorbed by the cushioning layer which consists of a polymeric foam backing. The foam backing is, in turn, covered by another hydrophilic layer, which in one embodiment is synthetic sheepskin and in the other is a cloth cover. Details of construction are included below as is a description of a withers relief gusset.

OBJECTS AND FEATURES OF THE INVENTION

It is an object of the present invention to provide a saddle pad utilizing a microfiber filamentous fabric with a high rate of moisture wicking;

It is another object of the present invention to provide a layered saddle pad construction that enhances and optimizes wicking and absorption of perspiration;

It is a yet further object to provide a layered saddle pad construction that is light weight and combines comfort fabric with a foam backing layer for cushioning;

It is a feature of the present invention to use a comfort fabric made from passive performance fibers, such as a COOLMAX® fabric.

Other objects and features of the present invention become apparent by the review of drawings and specification which follow.

BRIEF DESCRIPTION OF THE DRAWINGS

In the drawings similar parts in the various views are provided with the same reference designators.

DESCRIPTION OF PREFERRED EMBODIMENTS

Figure 1:
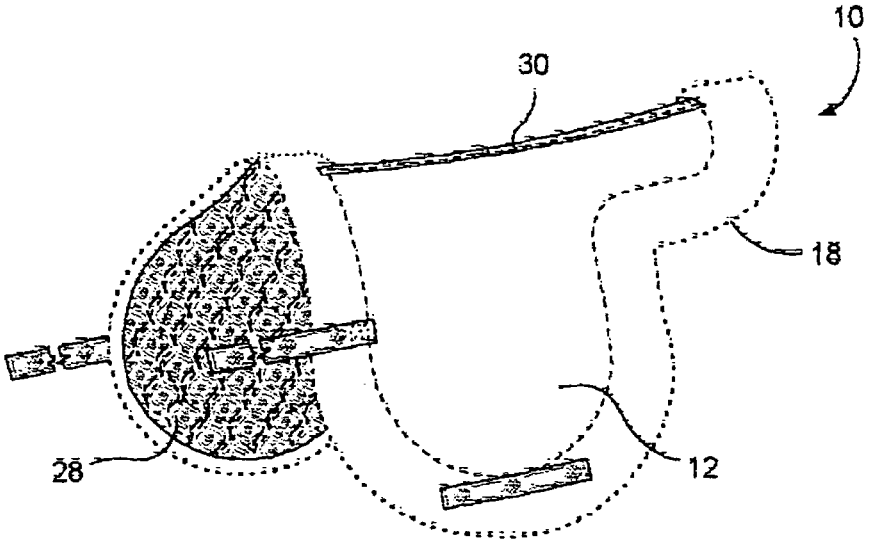
FIG. 1 is a perspective view of the first embodiment of the moisture-wicking saddle pad of the present invention.
Figure 2:
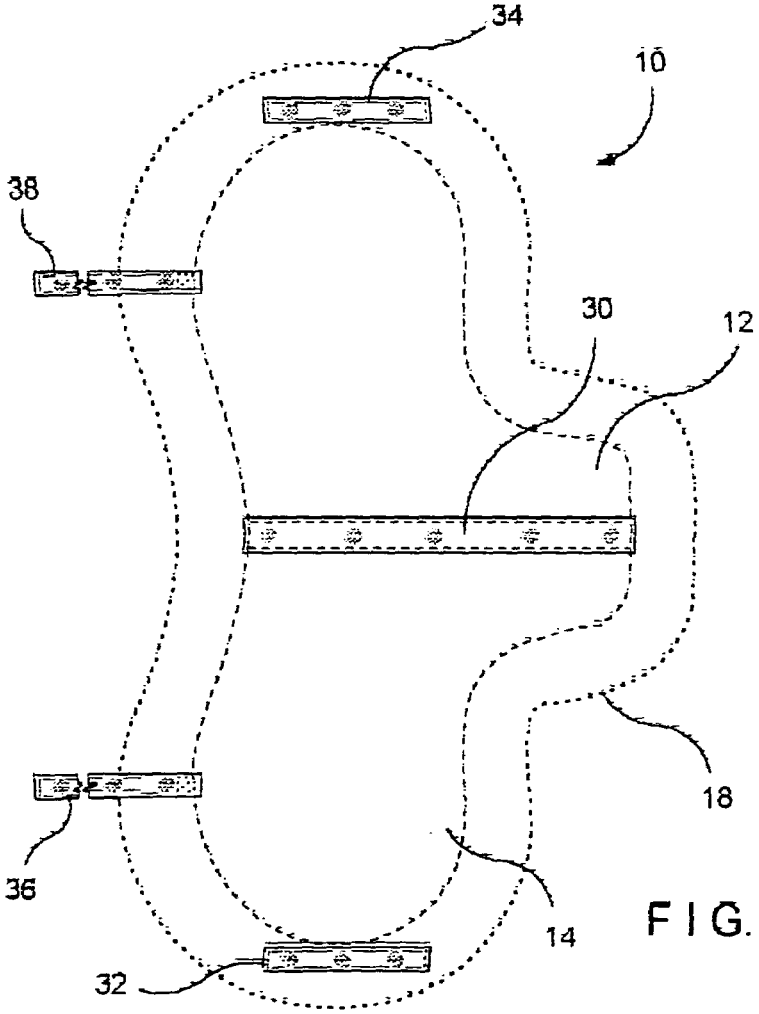
FIG. 2 is a top plan view of FIG. 1.
Figure 3:
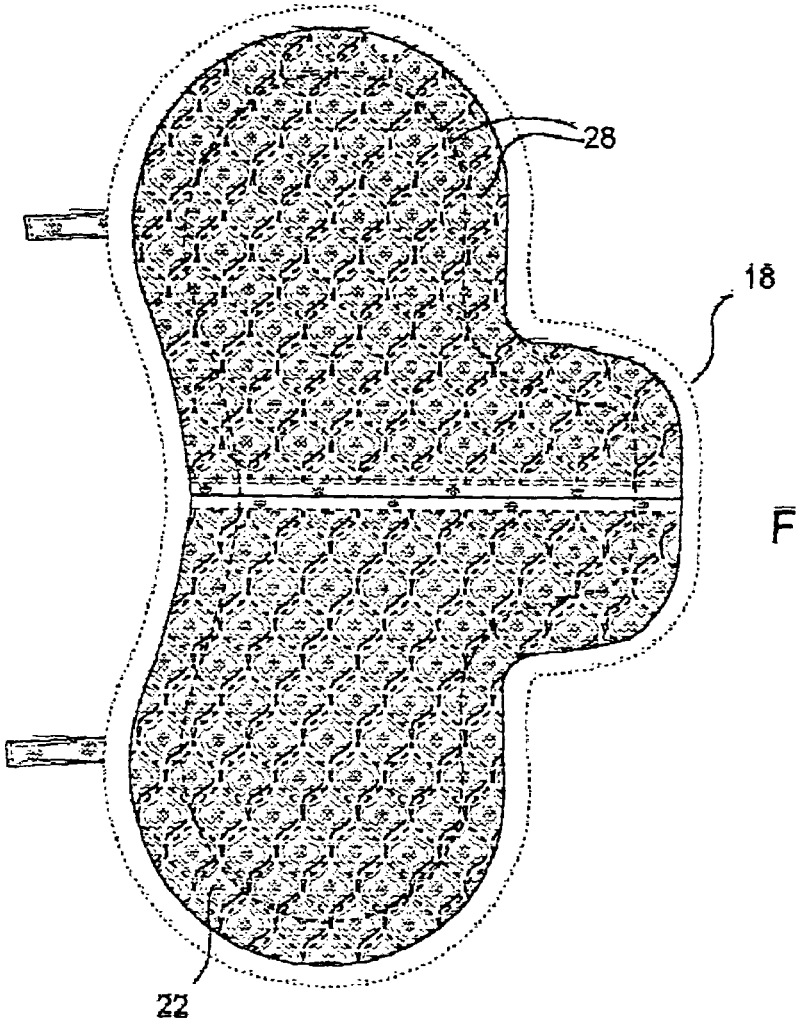
FIG. 3 is a bottom plan view of FIG. 1.

For the purposes of this Description, the definitions of "passive performance fibers" and "comfort fabrics" are derived from the article in the *International Fiber Journal* and the DuPont patents cited hereinabove. A passive performance fiber is defined as a sculpted fiber, generally scalloped oval in cross section and having longitudinal grooves in the surface thereof which grooves create a mechanism for wicking away or transporting water from a body. A "comfort fabric" is defined as one utilizing a passive performance fiber and employed in an article that wicks perspiration away from a body.

In the first embodiment a moisture-wicking saddle pad is constructed entirely from synthetic materials. The structure is layered and provides optimal comfort for the horse by having a unique arrangement using recently developed comfort materials. In this embodiment, the pad is constructed with an upper shell which is peripherally attached to the lower shell assemblage and thus may be considered to be a self-binding pad.

Referring now to FIGS. 1 through 4 the saddle pad of the first embodiment is shown and is referred to generally by the reference designator 10. The upper shell 12 is a synthetic fleece body 14 mounted on a substrate or an open-weave backing material 16. Unlike natural fleece and, because there are no natural oils to wash off, synthetic fleece 14 retains its compressibility and memory after numerous washings. As noted in Leson, U.S. Pat. No. 6,421,989, supra, saddle pads constructed from natural materials such as raw wool, upon use, lose the natural oils during cleaning and have substantial changes in physical properties.

Figure 4:
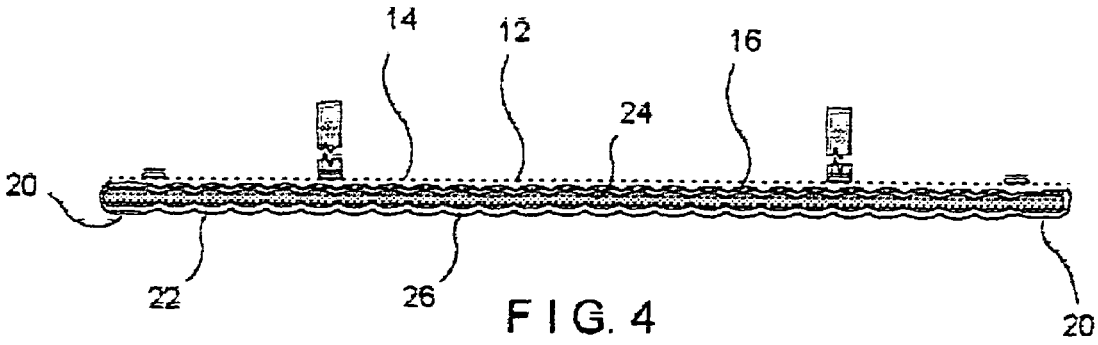
FIG. 4 is a cross-sectional view of FIG. 4 taken along line 4—4.
Figure 5:
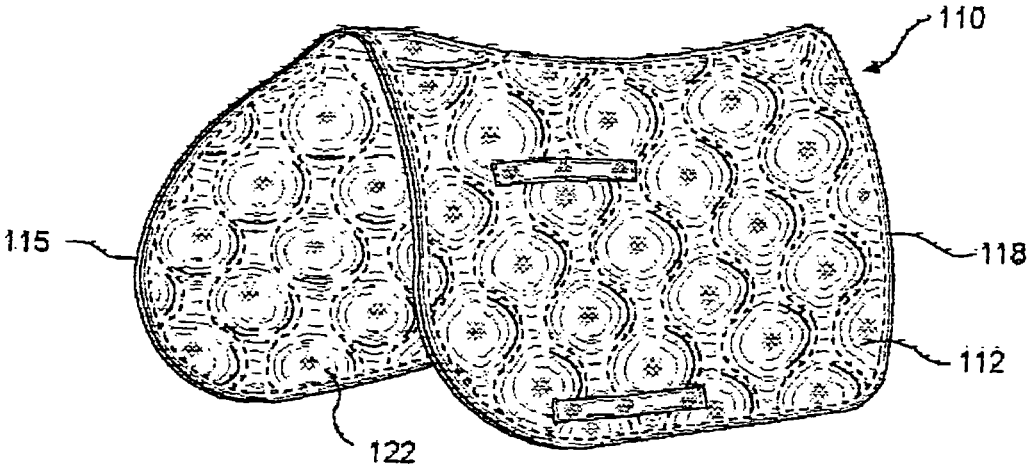
FIG. 5 is a perspective view of the second embodiment of the moisture-wicking saddle pad of the present invention, similar to FIG. 1, but being styled differently and having a different upper shell structure.
Figure 6:
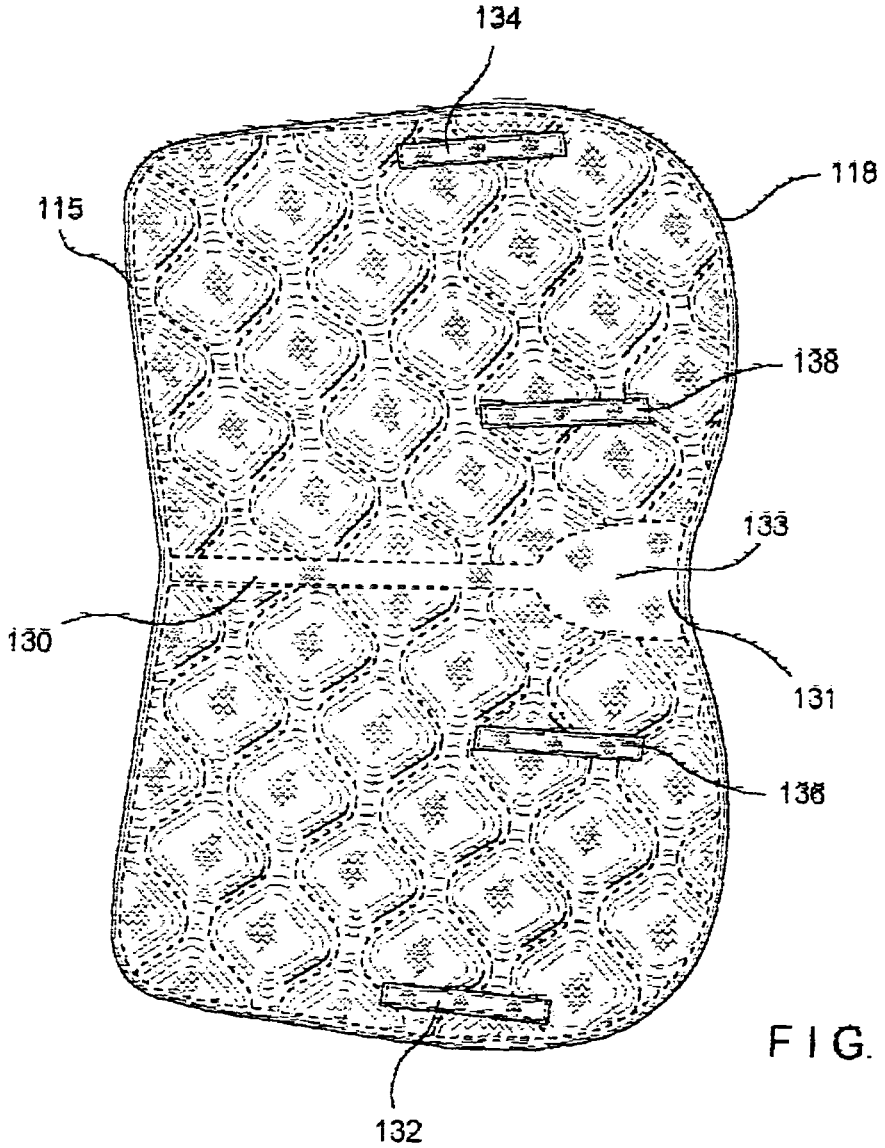
FIG. 6 is a top plan view of FIG. 5.
Figure 7:
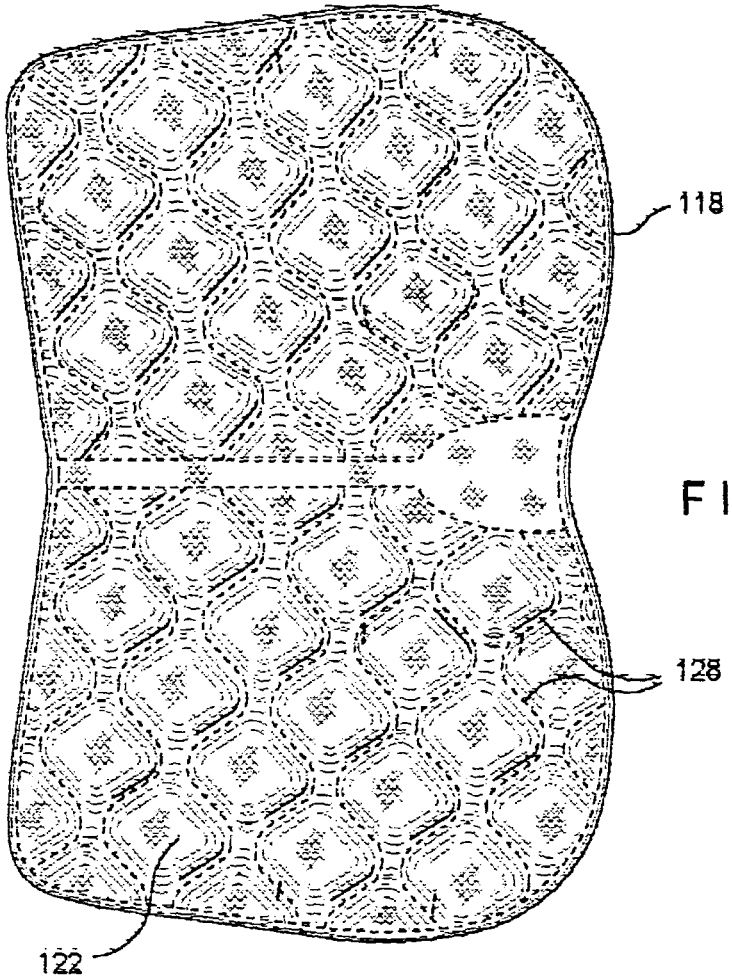
FIG. 7 is a bottom plan view of FIG. 5.

As best seen in the cross-sectional view FIG. 4, the perimeter or outer edge 18 is rolled to form a binding portion 20 that surrounds a lower shell 22. The lower shell 22 is an assemblage of a foam pad 24 and an outer cloth cover 26 fashioned from a fabric constructed of a microfiber filament—a passive performance fiber—described in greater detail hereinbelow. The foam pad 24, which acts to cushion the impact forces experienced during a ride, is a polymeric cushion foam. The cushion foam is either an open- or a closed-cell plastic foam selected from a cross-linked, low-density polyethylene; ethylene vinyl acetate (EVA); or, polyurethane. It is noted that such foams are most often admixtures of open and closed cells with the "open" and "closed" designation following the predominant cell structure.

In this embodiment, the foam pad 24 is attached to cover 26 by an hour glass quilting stitch 28 which is both decorative and functional. The all-over stitching 28 precludes the shifting or bunching up of the pad 24 relative to the cover 26. As mentioned previously the cover 26 is manufactured from a passive performance fiber under license from DuPont and is known as COOLMAX® fabric, a comfort fabric. The fiber is a sculpted fiber that when extruded is scalloped-oval in cross-section and has a plurality—four or more—of longitudinal channels. Products utilizing fabrics of these fibers are known for moisture-wicking superiority and special applications of the material continue to be found. Because the wicking characteristic is a function of the channeling of the fiber, the wicking does not change with fabric maintenance.

A nylon webbing or strap 30 is attached to the topside of saddle pad 10 and, when the pad is placed on the horse, the webbing follows the spine of the horse and bridges the two symmetrical sides of the saddle pad 10. Upon installation the forward portion of the strap 30 is constructed to be pulled upwards so that the area surrounding the withers of the horse is relieved.

Other nylon webbing or straps are mounted on the upper shell 12 to aid in the installation of the saddle pad 10 and saddle (not shown). These include girth straps 32 and 34 and billet straps 36 and 38.

In use, the saddle pad 10 of the embodiment just described wicks the perspiration of the horse along the fiber channels of the COOLMAX® comfort fabric 26 and transports the perspiration through the foam pad 24 to the area of most highly hydrophilic material, namely, the synthetic fleece 14 of upper shell 12. Thus, after a ride when the saddle pad is demounted from the horse, the inner surface is dry and the outer surface is wet. Additionally, because synthetic materials are used, washing or hosing down the pads will not change the physical properties thereof.

Turning now to the second embodiment, another moisture-wicking saddle pad is shown which follows the same principles of construction as the above. In the drawing for this embodiment parts similar to those in the first embodiment are afforded reference designators "100" units higher. Thus, girth strap 132 is analogous to girth strap 32 of the first embodiment.

Referring now to FIGS. 5 through 8, the second embodiment is shown and is referred to generally by the reference designator 110. The upper shell or cover 112 is a plain fabric such as cotton or nylon and, as a portion of the pad extends, when installed, beyond the saddle, the color of the cover can be selected to match the silks of the owners. Further, in the embodiment as the upper shell 112 is a cloth cover, the binding is external double-roped binding 115.

Figure 8:
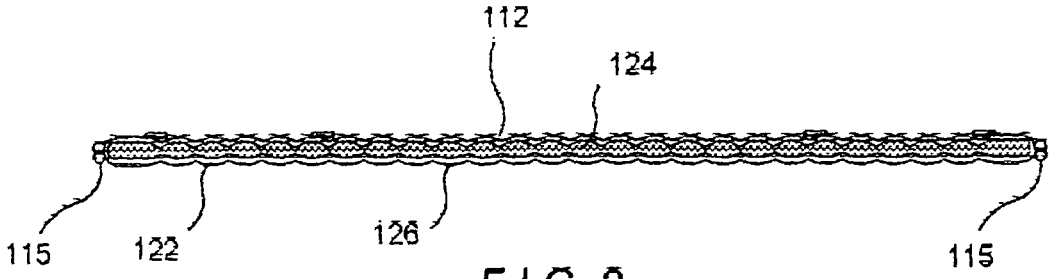
FIG. 8 is a cross-sectional view of FIG. 6 taken along line 8—8.

As best seen in the cross-sectional view FIG. 8 the perimeter or outer edge 118 is attached by the double-roped binding 115 to a lower shell 122. Like the prior embodiment the lower shell 122 is an assemblage of a foam pad 124 and an outer cloth cover 126 of COOLMAX® fabric. Here, the COOLMAX® fabric is 65% polyester and 35% COOLMAX® pique. As this embodiment lacks the extremely hydrophilic fleece cover, the foam for cushioning, while selected from the same materials, is optimally more sponge-like and holds more of the perspiration wicked away by the COOLMAX® fabric.

The foam pad 124 is sandwiched between upper shell 112 and lower shell 122 by the hour-glass quilting stitch 128 which, in this embodiment, penetrates all three layers. The stitching performs the same function as described above.

In the second embodiment, the central bridge 130 terminates at the forward end 131 thereof in a withers relief gusset or insert 133. This structure relieves stress on the withers of the horse. Because of the use of a cloth cover 112, the withers relief means 133 is more prominent in this embodiment. The nylon webbing for girth straps 132 and 134 and for billet, straps 136 and 138 are analogous to those of the first embodiment.

In use, the saddle pad 110 of the second embodiment wicks the perspiration of the horse along the channeled, sculpted fibers to the sponge—like foam mass therebehind. The superior wicking of the lower shell 122 results, after use, in the surface thereof being dry. This has been found to minimize irritation from saddles and saddle pads.

It is understood that variations and modifications of the present invention may be made without departing from the spirit thereof. Further, the present invention is not limited by the embodiments disclosed, but only by the appended claims when read together with the foregoing specification.

What is claimed is:

1. A moisture-wicking saddle pad for mounting between a saddle and a back of a horse comprising, in combination:

two symmetrical panels, one being the mirror image of the other, with a juncture therebetween said juncture adapted, upon mounting said saddle pad onto said horse to follow the spine of the horse:

a juncture webbing attached atop said juncture and forming a bridge between said two symmetrical panels;

each of said two symmetrical panels, in turn, comprising:

a lower covering layer of comfort fabric formed a fiber being scalloped oval in cross-section with longitudinal channels therealong;

a cushioning layer of a polymeric foam coextensive with said lower covering layer and attached thereto; and, an upper covering layer of hydrophilic material coextensive with said foam layer and attached thereto about the perimeter thereof and sandwiching said cushioning layer between said lower covering layer and said upper covering layer;

whereby, during use, said saddle pad is adapted to wick perspiration from said horse through said lower covering layer and said foam layer to said upper covering layer.

2. A saddle pad as described in claim 1 wherein said saddle pad further comprises a withers-relief gusset beneath and attached to one end of said juncture webbing, adapted, upon installation of said saddle pad on said horse, to be lifted away from the withers of said horse to relieve any stress thereon.

3. A saddle pad as described in claim 1 wherein said passive performance fiber has four longitudinal channels and said comfort fabric is 65% by weight of polyester and 35% by weight of the passive performance fiber.

4. A moisture-wicking saddle pad for mounting between a saddle and a back of a horse comprising, in combination:

a pair of symmetrical, cushioned panels, one being the mirror image of the other, with a juncture therebetween:

a juncture webbing forming a bridge between said cushioned panels and attached atop thereof;

a withers-relief gusset beneath and attached to one end of said juncture webbing, adapted, upon installation of said saddle pad on said horse, to be lifted away from the withers of said horse to relieve any stress thereon;

each of said pair of cushioned panels, in turn, comprising:

a lower covering layer of comfort fabric formed a fiber being scalloped oval in cross-section with longitudinal channels therealong;

a cushioning layer of a polymeric foam coextensive with said lower covering layer and attached thereto; and, an upper covering layer of hydrophilic material coextensive with said foam layer and attached thereto about the perimeter thereof and sandwiching said cushioning layer between said lower covering layer and said upper covering layer;

whereby, during use, said saddle pad is adapted to wick perspiration from said horse through said lower covering layer and said foam layer to said upper covering layer.

5. A saddle pad as described in claim 4 wherein said polymeric foam is selected from a group consisting of polyethylene foam, ethylene vinyl acetate foam, and polyurethane foam.

6. A saddle pad as described in claim 4 wherein said passive performance fiber has four longitudinal channels and said comfort fabric is 65% by weight of polyester and 35% by weight of the passive performance fiber.

* * * * *